US009110399B2

(12) United States Patent
Masuda et al.

(10) Patent No.: US 9,110,399 B2
(45) Date of Patent: Aug. 18, 2015

(54) OPTICAL WRITING DEVICE AND IMAGE FORMING APPARATUS

(71) Applicant: Konica Minolta, Inc., Chiyoda-ku (JP)

(72) Inventors: Satoshi Masuda, Neyagawa (JP); Yoshikazu Watanabe, Toyohashi (JP); Makoto Obayashi, Toyokawa (JP); Masayuki Iijima, Okazaki (JP); So Yano, Ibaraki (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 14/204,725
(22) Filed: Mar. 11, 2014

(65) Prior Publication Data

US 2014/0267527 A1 Sep. 18, 2014

(30) Foreign Application Priority Data

Mar. 13, 2013 (JP) ..... 2013-049923

(51) Int. Cl.

| | |
|---|---|
| ***B41J 29/393*** | (2006.01) |
| ***G03G 15/043*** | (2006.01) |
| ***G03G 15/04*** | (2006.01) |

(52) U.S. Cl.
CPC ..... *G03G 15/043* (2013.01); *G03G 15/04054* (2013.01)

(58) Field of Classification Search
CPC ..... B41J 2/471; B41J 2/45; B41J 2/442; B41J 2/451; G06K 15/1247; G06K 15/1209; G06K 15/1214
See application file for complete search history.

(56) References Cited

U.S. PATENT DOCUMENTS

| | | | | |
|---|---|---|---|---|
| 6,989,849 | B2 | 1/2006 | Nomura et al. | |
| 7,417,659 | B2 * | 8/2008 | Yamamura | 347/241 |
| 7,460,141 | B2 * | 12/2008 | Detmers et al. | 347/133 |
| 8,854,407 | B2 * | 10/2014 | Kamei | 347/238 |
| 2004/0125196 | A1 | 7/2004 | Nomura et al. | |
| 2009/0321751 | A1 | 12/2009 | Miyao et al. | |

FOREIGN PATENT DOCUMENTS

| | | |
|---|---|---|
| JP | 2004-082330 | 3/2004 |
| JP | 2004-082330 A | 3/2004 |
| JP | 2009-001024 | 1/2009 |
| JP | 2009-023261 | 2/2009 |
| JP | 2010-008539 | 1/2010 |
| JP | 2010-023390 | 2/2010 |
| JP | 2010-087245 | 4/2010 |
| JP | 2010-087245 A | 4/2010 |
| JP | 2011-023388 | 2/2011 |

OTHER PUBLICATIONS

Notice of Reasons for Refusal issued in corresponding Japanese Patent Application No. 2013-049923, mailed Jan. 20, 2015, and English translation thereof (10 pages).

* cited by examiner

*Primary Examiner* — Lamson Nguyen
(74) *Attorney, Agent, or Firm* — Buchanan Ingersoll & Rooney PC

(57) ABSTRACT

An optical writing device for forming an electrostatic latent image on a photoreceptor by exposing the photoreceptor to light modulated in accordance with image data. The optical writing device has: a substrate; a light-emitting-element array including a plurality of light-emitting elements supported by the substrate to be arranged in a main-scanning direction; and a light-receiving-element array substantially in parallel to the light-emitting-element array, the light-receiving-element array including a plurality of light-receiving elements supported by the substrate to be arranged in the main-scanning direction. For light-quantity measurement of one of the light-emitting elements, at least an output value output from one of the light-receiving elements of which center is located in a different position, with respect to the main-scanning direction, from a center of the one of the light-emitting elements is used.

15 Claims, 14 Drawing Sheets

13

OPTICAL WRITING DEVICE AND IMAGE FORMING APPARATUS

This application claims the benefit of Japanese Patent Application No. 2013-049923 filed on Mar. 13, 2013, the content of which is incorporated herein by reference.

BACKGROUND OF THE INVENTION

1. Field of the Invention

The present invention relates to an optical writing device, and more particularly to an optical writing device for forming an electrostatic latent image on a photoreceptor, and an image forming apparatus comprising the optical writing device.

2. Description of Related Art

In regard to electrophotograhic image forming apparatuses such as printers and copying machines, recently, a demand for downsizing is getting stronger. In order to comply with the demand, optical writing devices of a kind that are called printer heads are being changed from an optical scanning type using a conventional laser diode as a light source to a line optical type having very small light-emitting elements, which correspond to dots, arranged in a line.

As an example of the line optical type, an optical writing device using light-emitting diodes (LEDs) as light sources has been developed. Further, recently, using organic EL elements as light sources is suggested. In a case of using organic EL elements, the light-emitting portions and a drive circuit section therefor can be mounted on a single substrate, while in a case of using LEDs, the light-emitting portions need to be mounted on a substrate separate from a drive circuit section therefor. Therefore, in terms of cost, using organic EL elements is more advantageous than using LEDs.

However, an organic EL element, in principle, has the following light-emission degradation characteristics: the quantity of emitted light becomes smaller as the cumulated light-emitting time increases; the rate of progression of light-emission degradation differs depending on luminance; and the degree of light-emission degradation differs depending on temperature.

Accordingly, when such organic EL elements having the light-emission degradation characteristics above are used as light sources, the cumulated light-emitting times of the respective organic EL elements are different depending on written images, and the respective organic EL elements have different degrees of light-emission degradation. In order to deal with this problem, it is necessary to carry out light-emission adjustment in a pixel-by-pixel manner.

Japanese Patent Laid-Open Publication No. 2010-87245 discloses a luminescent device having a light-receiving-element array and a light-emitting-element array mounted on a single substrate at a distance equal to or greater than a distance determined from the critical angle (critical-angle-determined distance Lc) from each other. In the structure, the efficiency of the light-receiving-element array in receiving total-reflected light is improved, and accurate light-quantity measurement can be carried out.

In the luminescent device disclosed by Japanese Patent Laid-Open Publication No. 2010-87245, however, the light-receiving-element array needs to be located at a distance equal to or greater than about 1.1 mm in a sub-scanning direction from the light-emitting-element array, thereby requiring a larger substrate. Considering that conventional substrates for this type of luminescent devices have a size of about 10 mm in the sub-scanning direction, the distance (about 1.1 mm), which appears small, is large enough to contribute to an area increase of the substrate. In the manufacture, as many elements as possible are mounted on a large-size mother glass at one time to reduce the manufacturing cost. However, as the area of one substrate increases, the number of substrates cut out from the mother glass is reduced, and accordingly, the production cost and the cost for material are increased.

SUMMARY OF THE INVENTION

A first object of the present invention is to provide an optical writing device having a substrate of which size in a sub-scanning direction is inhibited from enlarging. A second object of the present invention is to provide an optical writing device having light-receiving elements receives light with higher efficiency. A third object of the present invention is to provide an image forming apparatus that carries out light-emission adjustment of light-emitting elements by use of the optical writing device.

An optical writing device according to a first aspect of the present invention is to form an electrophotographic image on a photoreceptor by exposing the photoreceptor to light modulated in accordance with image data, and the optical writing device comprises: a substrate; a light-emitting-element array including a plurality of light-emitting elements supported by the substrate to be arranged in a main-scanning direction; and a light-receiving-element array substantially in parallel to the light-emitting-element array, the light-receiving-element array including a plurality of light-receiving elements supported by the substrate to be arranged in the main-scanning direction. For light-quantity measurement of one of the light-emitting elements, at least an output value output from one of the light-receiving elements of which center is located in a different position, with respect to the main-scanning direction, from a center of the one of the light-emitting elements is used.

DETAILED DESCRIPTION OF THE PREFERRED EMBODIMENTS

Optical writing devices and image forming apparatuses according to some embodiments of the present invention will be hereinafter described with reference to the drawings.

Image Forming Apparatus; See FIG. 1

Figure 1:
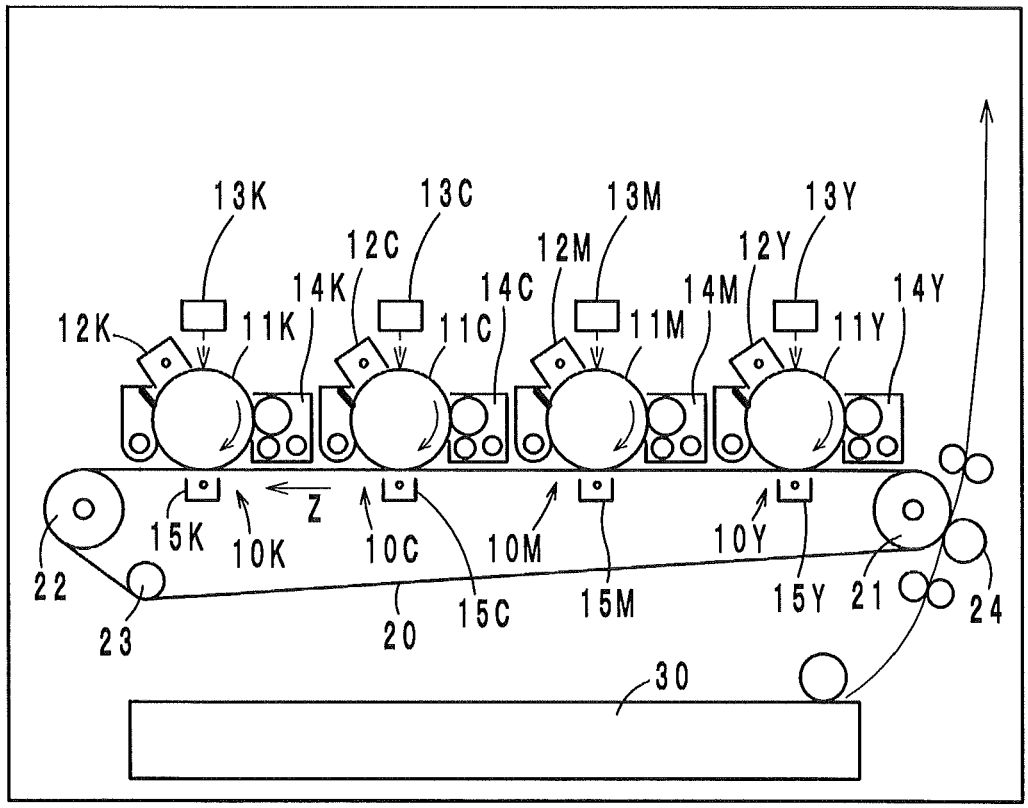
FIG. 1 is a schematic view showing a basic structure of an image forming apparatus according to an embodiment of the present invention.

FIG. 1 shows an image forming apparatus according to an embodiment of the present invention. The image forming apparatus 1 is an electrophotographic color printer and forms images in four colors (Y: yellow, M: magenta, C: cyan and K: black) in a tandem method. The images are formed at respective image forming stations 10, and the images are transferred to an intermediate transfer belt 20. Thereby, the images are combined to become a composite image. In the drawings, the characters Y, M, C and K suffixed to the reference numbers mean that the components denoted thereby are for yellow images, magenta images, cyan images and black images, respectively.

Each of the image forming stations 10 (10Y, 10M, 10C, 10K) generally comprises a photoreceptor drum 11 (11Y, 11M, 11C, 11K), a charger 12 (12Y, 12M, 12C, 12K), an optical writing device 13 (13Y, 13M, 13C, 13K), which will be described later, a developing device 14 (14Y, 14M, 14C, 14K), a transfer charger 15 (15Y, 15M, 15C, 15K), etc.

The photoreceptor drums 11 are exposed to light emitted from the respectively corresponding optical writing devices 13, whereby electrostatic latent images are formed on the photoreceptor drums 11. The electrostatic latent images are developed into toner images by the developing devices 14. Immediately under the image forming stations 10, an intermediate transfer belt 20 is stretched endlessly among rollers 21, 22 and 23, and is driven to rotate in a direction shown by arrow Z. A secondary transfer roller 24 is opposed to the driving roller 21 via the intermediate transfer belt 20 (secondary transfer area). In a lower section of the image forming apparatus 1, an automatic sheet feeder 30 is provided, and sheets of a transfer material are stacked in the automatic sheet feeder 30. The automatic sheet feeder 30 feeds the sheets one by one.

From an image reader (scanner), a computer or the like, image data are sent to an image processing unit (not shown) for each of the colors Y, M, C and K. The optical writing devices 13 are driven in accordance with the image data for the respectively corresponding colors to form toner images on the corresponding photoreceptor drums 11. The electrophotographic process is well known, and a description thereof is omitted.

The toner images formed on the respective photoreceptor drums 11 are transferred to the intermediate transfer belt 20 (primary transfer) one by one while the intermediate transfer belt 20 is driven to rotate in the direction Z. Thereby, the four color images are combined to become a composite toner image. Meanwhile, one is picked out from the sheets stored in the automatic sheet feeder 30 and fed upward, and at the secondary transfer area, the sheet receives the composite toner image transferred from the intermediate transfer belt 20 by the effect of an electric field applied by the transfer roller 24. Thereafter, the sheet is fed to a fixing device (not shown), where the toner is fixed on the sheet by heat. Then, the sheet is ejected to an upper surface of the image forming apparatus 1.

Optical Writing Device; See FIGS. 2 and 3

Figure 2:
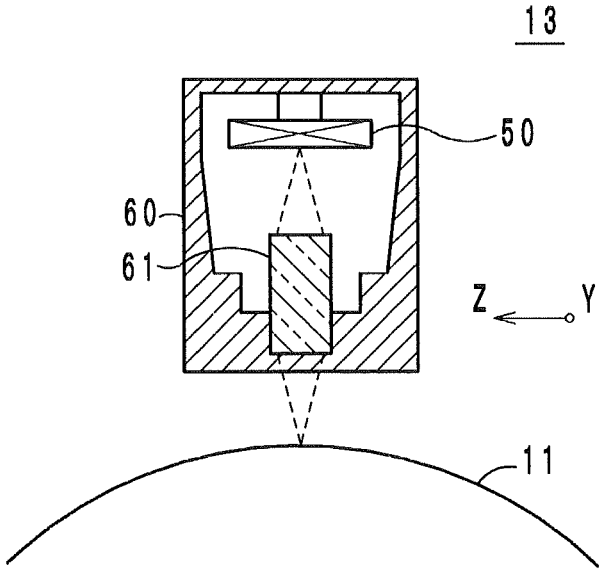
FIG. 2 is a sectional view of an optical writing device taken in a sub-scanning direction.
Figure 3:
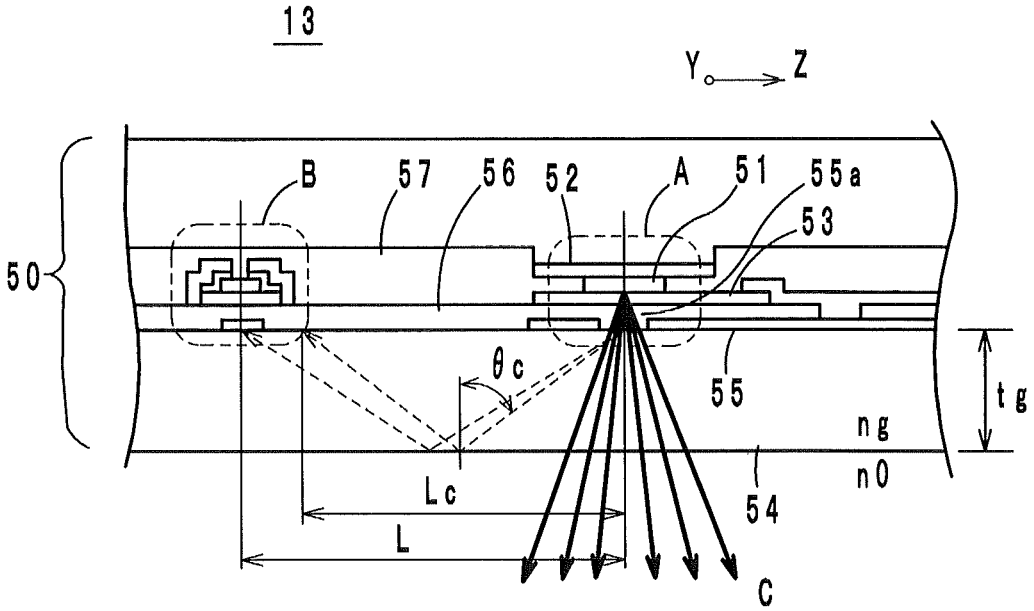
FIG. 3 is an enlarged sectional view of an important part of the optical writing device taken in the sub-scanning direction.

The optical writing devices 13 are described with reference to FIGS. 2 and 3. In FIG. 3, hatching is omitted for the purpose of avoiding complication. In the following, only one of the optical writing devices 13 will be described, but the other optical writing devices 13 have the same structure and the same function as will be described below.

The optical writing device 13 is configured to form an electrostatic latent image on the corresponding photoreceptor drum 11 by exposing the photoreceptor drum 11 to light modulated in accordance with image data. The optical writing device 13 comprises a light-emitting-element array and a light-receiving-element array mounted on a substrate 50. The light-emitting-element array comprises a plurality of light-emitting elements A (A1, A2 . . . ) arranged in a main-scanning direction Y, and the light-receiving-element array comprises a plurality of light-receiving elements B (B1, B2 . . . ) arranged in the main-scanning direction Y substantially in parallel to the light-emitting elements A.

The light-emitting elements A are organic EL elements. Each of the organic EL elements has an EL layer 51 sandwiched between a cathode layer 52 and an anode layer 53, and further, has a glass substrate 54 that is transmissive in reaction to the emission wavelength, a gate layer 55 having an opening 55*a*, and insulating layers 56 and 57. Each of the light-receiving elements B is a field-effect transistor disposed in the insulating layers 56 and 57. The structures and the light-emitting/light-receiving operation of the light-emitting element A (organic EL element) and the light-receiving element B (field-effect transistor) are well known, and detailed descriptions thereof are omitted.

The substrate 50 and a rod lens array 61 are held in a holder 60. Light emitted from the EL layer 51 through the opening 55*a* passes through the glass substrate 54. The light C emergent from the glass substrate 54 is focused by the rod lens array 61 on the photoreceptor drum 11, whereby the photoreceptor drum 11 is exposed to the light. The light-receiving element B receives divergent light that was reflected by the interface of the glass substrate 54 without contributing to the exposure of the photoreceptor drum 11. Based on an output value from the light-receiving element B, the quantity of light emitted from the light-emitting element A is detected.

The glass substrate 54 has a refractive index ng larger than the refractive index n0 of the air, and divergent light incident to the glass substrate 54 at an angle larger than a critical angle θc is total-reflected by the interface of the glass substrate 54 and does not go out of the glass substrate 54. The light-receiving element B receives such total-reflected light. The critical angle is expressed by $\theta c = \arcsin(n0/ng)$. The critical-angle-determined distance Lc is expressed by $Lc = 2 \cdot tg \cdot \tan \theta c$. The distance L between the light emission center of the light-emitting element A and the light receiving center of the light-receiving element B is determined based on the critical-angle-determined distance Lc. As will be described later, it is preferred that the distance L is set to be 0.54 times to 7.6 times the critical-angle-determined distance Lc.

Figure 4:
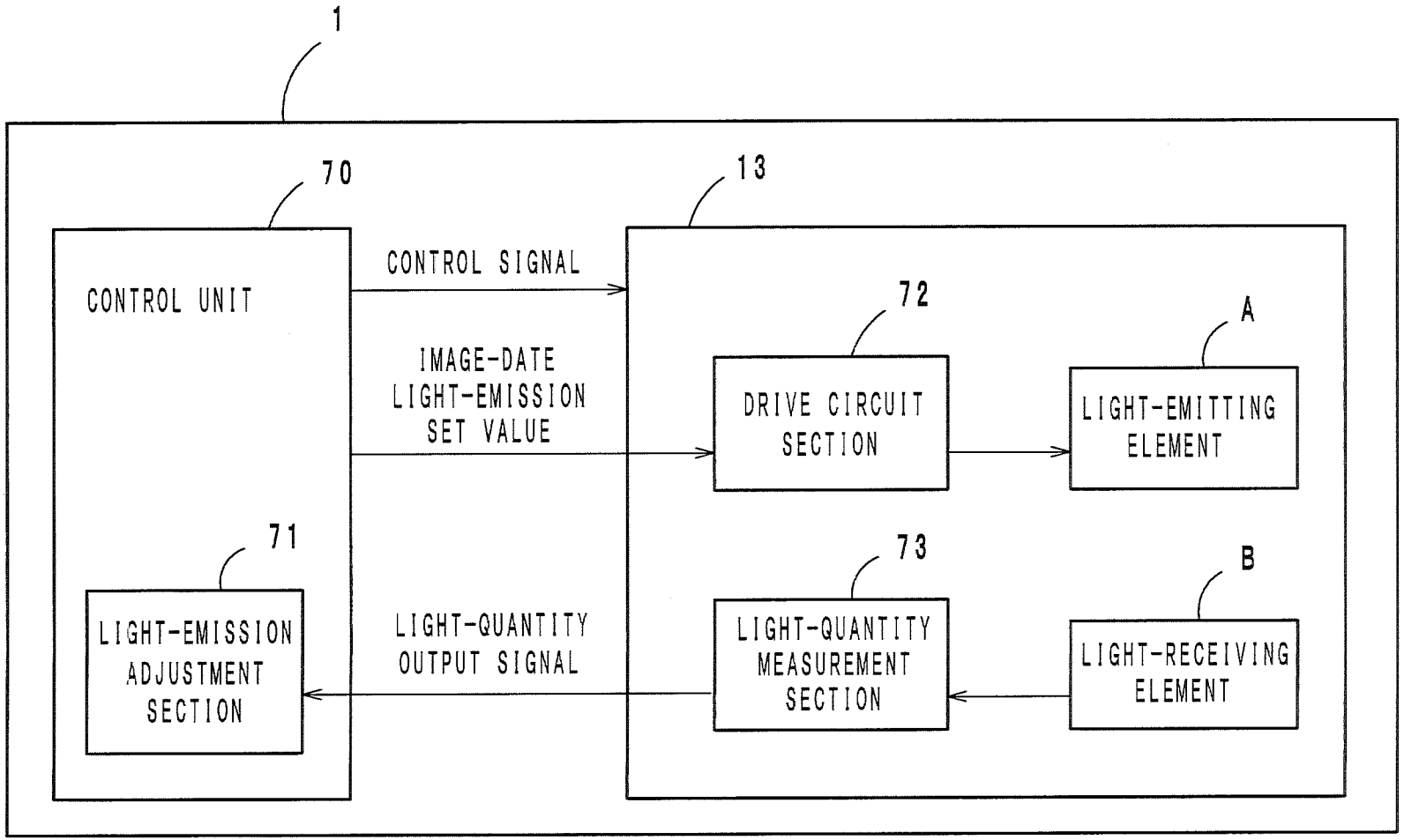
FIG. 4 is a block diagram of a control unit.

Control Unit; See FIG. 4

A control unit 70 for controlling the image forming apparatus 1 comprises a light-quantity adjustment section 71. Each of the optical writing devices 13 has a drive circuit section 72 for the light-emitting elements A, and a light-quantity measurement circuit section 73 for the light-receiving elements B. The control unit 70 outputs control signals and image-data light-emission set values to each of the optical writing device 13. The light-quantity measurement circuit section 73 converts an output value from each of the light-emitting elements B into a light-quantity output signal, and the light-quantity output signal is sent to the light-emission adjustment section 71.

During ordinary optical writing, the control unit 70 sends control signals (a horizontal synchronization signal, a clock signal, etc.) and image data to each of the optical writing device 13. In each of the optical writing devices 13, the drive circuit section 72 controls the turn-on/turn-off times of each of the light-emitting elements A in accordance with the image data received, whereby an electrostatic latent image is formed on the photoreceptor drum 11.

The setting of a light-emission value (intensity) on each of the light-emitting elements A is carried out prior to optical writing operation. For example, when the image forming apparatus is powered on, a light-emission set value is read out from a memory provided for the optical writing device 13 and written in the drive circuit section 72, and the respective light-emitting elements A are controlled to emit a predetermined quantity of light.

The light-emission adjustment comprises a step of detecting divergent light by use of the light-receiving elements B, a step of measuring the quantities of light by use of the light-quantity measurement circuit section 73, and a step of calculating correction values and setting the light-emission values by use of the light-emission adjustment section 71. The light-quantity measurement and the correction value calculation will be described later with reference to FIG. 6.

First Embodiment; See FIGS. 5 and 6

Figure 5:
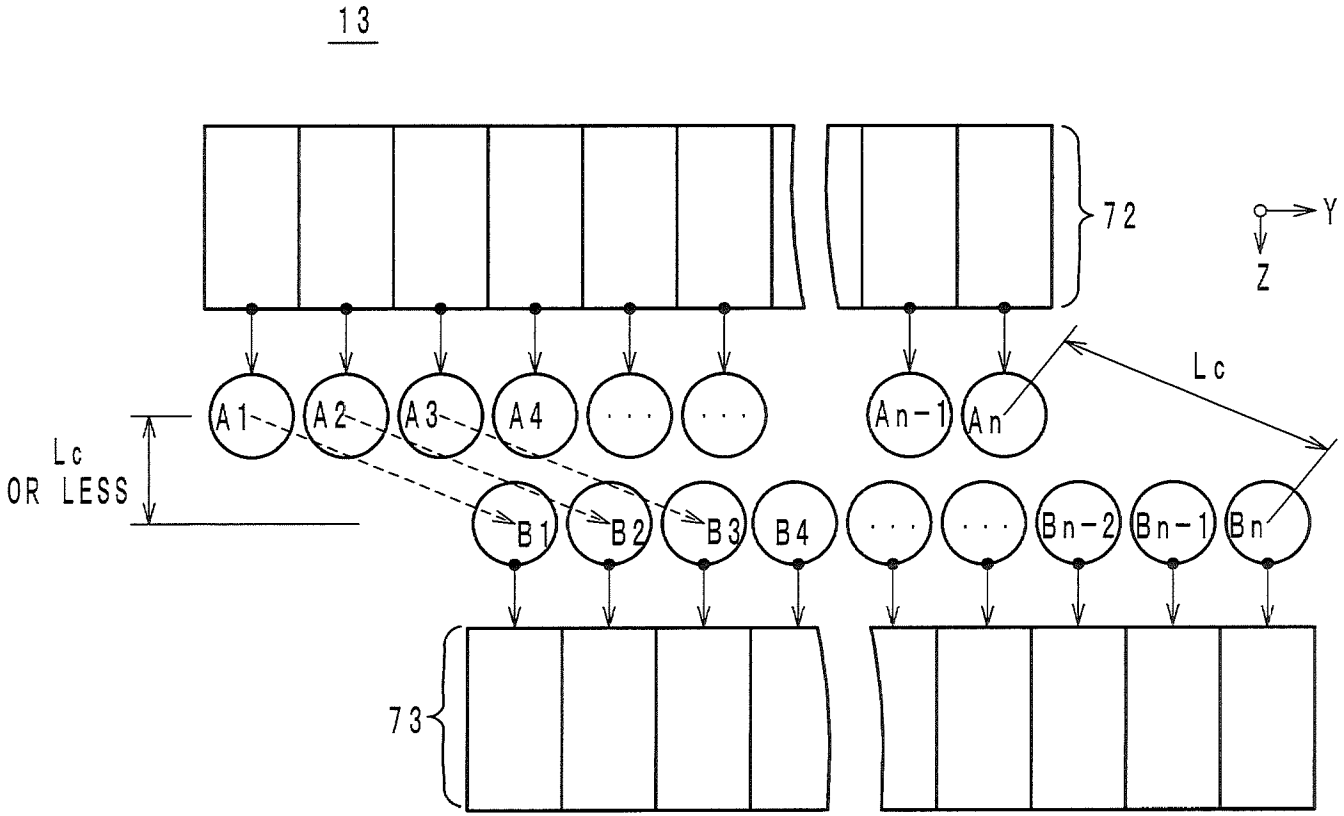
FIG. 5 is a schematic plan view of an optical writing device according to a first embodiment.

According to a first embodiment, in the optical writing device 13, as shown by FIG. 5, the light-emitting elements A in a row in the main-scanning direction Y (the light-emitting-element array) and the light-receiving elements B in a row in the main-scanning direction Y (the light-receiving-element array) are arranged side by side in the sub-scanning direction Z while being displaced from each other in the main-scanning direction Y. More specifically, the light-receiving-element array has substantially the same length (the same size in the main-scanning direction Y) as the light-emitting-element array, and these arrays are displaced from each other in the main-scanning direction Y. The amount of displacement in the main-scanning direction Y is such a value as to allow the distance between each pair of elements A and B (the distance between An and Bn in FIG. 5) to be equal to the critical-angle-determined distance Lc. Accordingly, the distance between each pair of elements A and B in the sub-scanning direction Z is less than Lc. Thus, it is possible to reduce the size of the substrate 50 in the sub-scanning direction Z.

The light-emitting elements A and the light-receiving elements B are the same in number and in arrangement pitch, and the light-emitting elements A and the light-receiving elements B are provided on a one-to-one basis. Accordingly, the quantity of light emitted from the light-emitting element A1 is detected by the light-receiving element B1, and the quantity of light emitted from the light-emitting element A2 is detected by the light-receiving element B2. Likewise, the quantity of light emitted from the light-emitting element An is detected by the light-receiving element Bn. With this arrangement wherein the light-emitting elements A and the light-receiving elements B are provided on a one-to-one basis, the structure of the light-quantity measurement circuit section 73 can be simplified.

Figure 6:
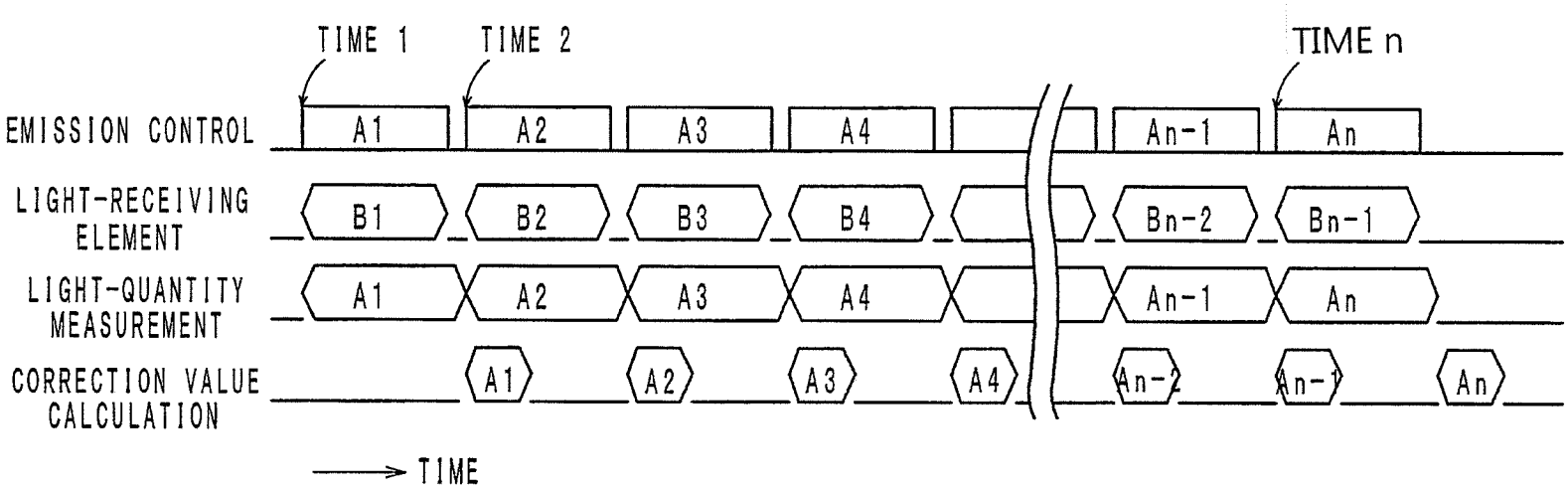
FIG. 6 is a chart showing an operation sequence of the optical writing device shown by FIG. 5.

An operation sequence for light-quantity measurement is described with reference to FIG. 6. All of the light-emitting elements A are driven one by one to emit light under predetermined conditions to achieve a predetermined light-quantity value, and the quantities of light actually emitted from the light-emitting elements A are detected by the respectively corresponding light-receiving elements B. It is preferred that light-quantity measurement is carried out sequentially from the light-emitting element A1. More specifically, at a time 1, only the light-emitting element A1 is lighted, and an output from the light-receiving element B1 is sent out from the light-quantity measurement circuit section 73. At a time 2, only the light-emitting element A2 is lighted, and an output from the light-receiving element B2 is sent out from the light-quantity measurement circuit section 73. The light-quantity measurement of each of the light-emitting elements A is carried out in the same way, and finally, at a time n, only the light-emitting element An is lighted, and an output from the light-receiving element Bn is sent out from the light-quantity measurement circuit section 73.

As described above, by adopting the simple driving method wherein the light-emitting elements A and the light-receiving elements B are driven sequentially, it is possible to simplify and downsize the circuit configuration.

Regarding the light-emission adjustment, while one of the light-emitting elements A is targeted for the light-quantity measurement, a correction value for light-emission adjustment is calculated for the light-emitting element A that was targeted for the light-quantity measurement one step before. In calculating the correction value, a difference between the light-quantity output signal output from the light-receiving element B and a reference value is calculated, and a light-emission set value (correction value) to make the difference zero is calculated. The calculated light-emission set value is overwrite-saved in the memory provided in the optical writing device 13.

Second Embodiment; See FIG. 7

Figure 7:
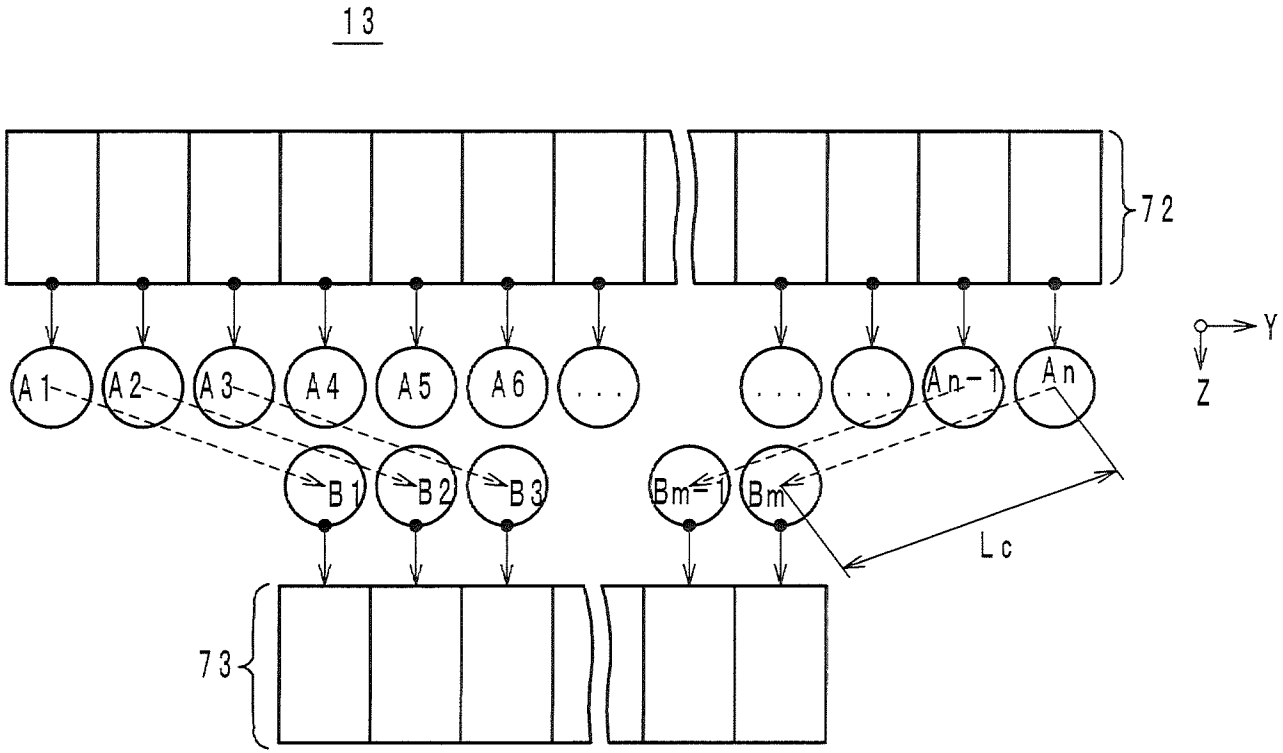
FIG. 7 is a schematic plan view of an optical writing device according to a second embodiment.

According to a second embodiment, in the optical writing device 13, as shown by FIG. 7, the number of light-receiving elements B (B1 to Bm) is smaller, than the number of light-emitting elements A (A1 to An), and the light-receiving-element array is shorter (has a smaller size in the main-scanning direction Y) than the light-emitting-element array. The optical writing device 13 according to the second embodiment basically has no other differences in structure from the optical writing device 13 according to the first embodiment. An operation sequence of the light-quantity measurement according to the second embodiment is different from the operation sequence of the light-quantity measurement according to the first embodiment. According to the second embodiment, since the number of light-receiving elements B is smaller, some of the light-receiving elements B are each used twice (to detect the quantities of light emitted from two light-emitting elements A).

More specifically, the quantity of light emitted from the light-emitting element A1 is detected by the light-receiving element B1, and the following light-emitting elements A are detected by the following light-receiving elements B on a one-to-one basis. Regarding the light-emitting elements A unpaired with the light-receiving elements B, the light-quantity measurement is carried out sequentially in the reverse order. More specifically, the quantity of light emitted from the last light-emitting element An is detected by the last light-receiving element Bm, and the quantity of light emitted from the second last light-emitting element An−1 is detected by the second last light-receiving element Bm−1. According to the second embodiment, the light-receiving-element array is shorter, and therefore, it is possible to downsize the substrate 50 in the main-scanning direction Y.

Third Embodiment; See FIG. 8

Figure 8:
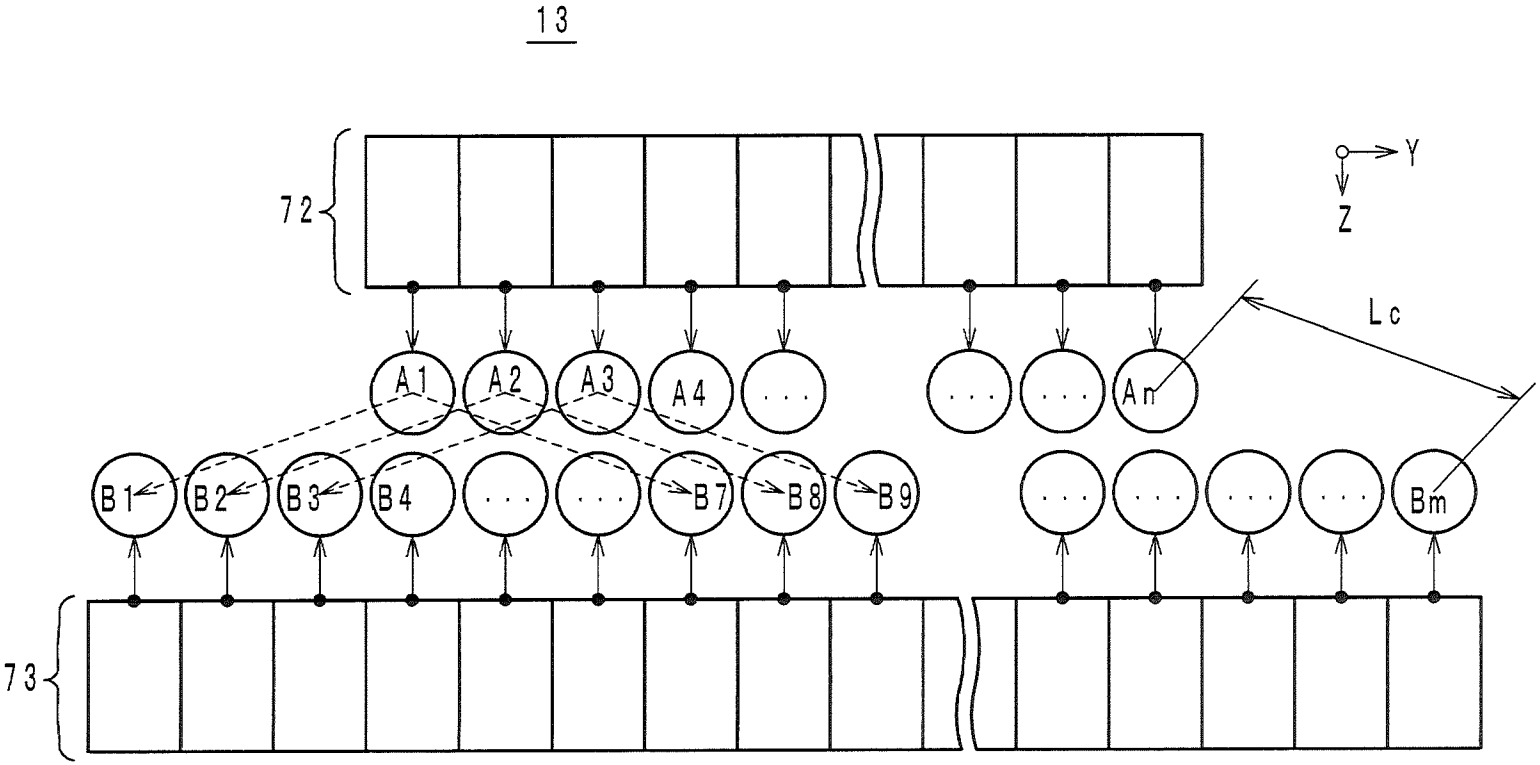
FIG. 8 is a schematic plan view of an optical writing device according to a third embodiment.

According to a third embodiment, in the optical writing device 13, as shown by FIG. 8, the number of light-receiving elements B (B1 to Bm) is larger than the number of light-emitting elements A (A1 to An), and the light-receiving-element array is longer (has a larger size in the main-scanning direction Y) than the light-emitting-element array. The optical writing device 13 according to the third embodiment basically has no other differences in structure from the optical writing device 13 according to the first embodiment. According to the third embodiment, the number of light-receiving elements B is larger, and for light-quantity measurement of each of the light-emitting elements A, two light-receiving elements B that are located at opposite sides of the targeted light-emitting element A in the main-scanning direction Y are used.

Specifically, the quantity of light emitted from the light-emitting element A1 is detected by the light-receiving elements B1 and B7, and the quantity of light emitted from the light-emitting element A2 is detected by the light-receiving elements B2 and B8. The quantities of light emitted from the other light-emitting elements A are detected sequentially in the same way. The quantity of light emitted from the last light-emitting element An is detected by the light-receiving elements Bn and Bm. In calculating a correction value for each of the light-emitting elements A, two output values from the two light-receiving elements B may be integrated or averaged. According to the third embodiment, the quantity of light emitted from each of the light emitting elements A is detected by two light-receiving elements B, thereby improving the accuracy of the light-quantity measurement. Consequently, the accuracy of the light-emission adjustment is improved.

Fourth Embodiment; See FIG. 9

Figure 9:
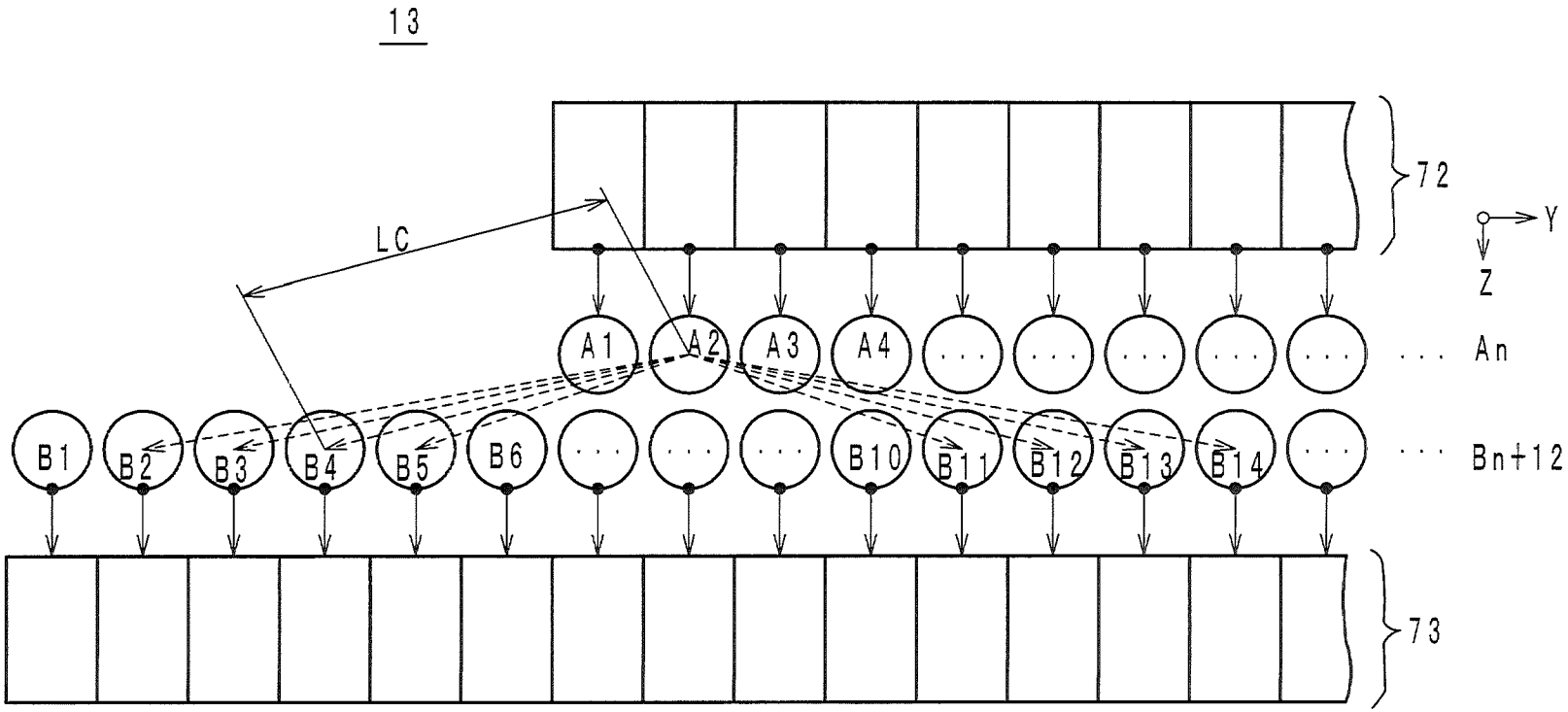
FIG. 9 is a schematic plan view of an optical writing device according to a fourth embodiment.

According to a fourth embodiment, in the optical writing device 13, as shown by FIG. 9, the number of light-receiving elements B (B1 to Bn+12) is larger than the number of light-emitting elements A (A1 to An), and the light-receiving-element array is longer (has a larger size in the main-scanning direction Y) than the light-emitting-element array. The light-receiving-element array is arranged such that six surplus light-receiving elements B protrude from each of the opposite edges in the main-scanning direction Y of the light-emitting-element array. The optical writing device 13 according to the fourth embodiment basically has no other differences in structure from the optical writing device 13 according to the first embodiment. According to the fourth embodiment, for the light-quantity measurement of each of the light-emitting elements A, eight light-receiving elements B that are located at opposite sides of the targeted light-emitting element A in the main-scanning direction Y are used.

More specifically, the quantity of light emitted from the light-emitting element A1 is detected by the eight light-receiving elements B1 to B4 and B10 to B13. The quantity of light emitted from each of the other light-emitting elements A is detected by eight light-receiving elements in the same way. The quantity of light emitted from the last light-emitting element An is detected by the eight light-receiving elements Bn to Bn+4 and Bn+9 to Bn+12. In calculating a correction value, eight output values from the eight light-receiving elements B may be integrated or averaged. According to the fourth embodiment, the quantity of light emitted from each of the light emitting elements A is detected by eight light-receiving elements B, thereby improving the accuracy of the light-quantity measurement. Consequently, the accuracy of the light-emission adjustment is improved.

Light-Receiving Distance L; See FIGS. 10-12

When a combination of a light-emitting-element array and a light-receiving-element array is used in the way described above, there exists an appropriate range of a light-receiving distance L (a distance between the respective centers of the light-emitting element A and the light-receiving element B in a pair).

Figure 10:
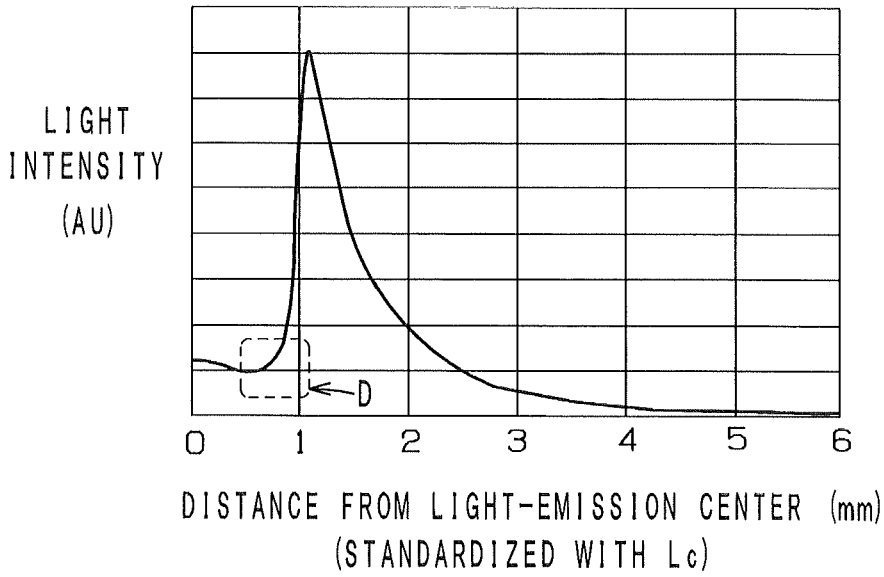
FIG. 10 is a graph showing a relation between the intensity of light entering to a light-receiving element from a light-emitting element and the distance between the light-emitting element and the light-receiving element.
Figure 11:
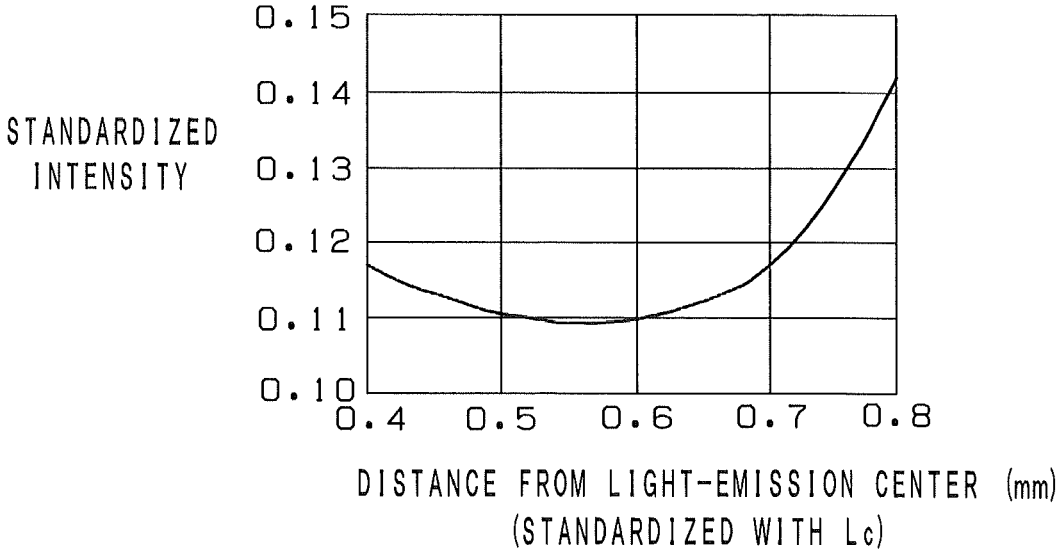
FIG. 11 is an enlarged view of an important part of the graph shown by FIG. 10.

FIG. 10 shows the intensity of light emitted from a light-emitting element and entering to a light-receiving element while the distance L between the center of the light-emitting element and the center of the light-receiving element is changed. FIG. 11 is a magnified view of an important part D. The intensity of light varies somewhat according to the pixel size. FIGS. 10 and 11 show a case wherein the pixel size is 200 μm in diameter (127 dpi). The pixel-size-dependent distance L is standardized with the critical-angle-determined distance Lc.

In any case where a light-emitting element has any surface area, the intensity of light entering thereto peaks when the distance L is close to the critical-angle-determined distance Lc. When the distance L is less than 0.54 Lc, divergent light emitted from the light-emitting element mostly passes through the glass substrate 54 without being reflected by the interface of the glass substrate 54. Accordingly, it is preferred that the distance L (for example, the distance between the element A2 and the element B5 in FIG. 9) is equal to or more than 0.54 Lc. Further, it is more desired that the distance L is equal to or more than 0.9 Lc.

Figure 12:
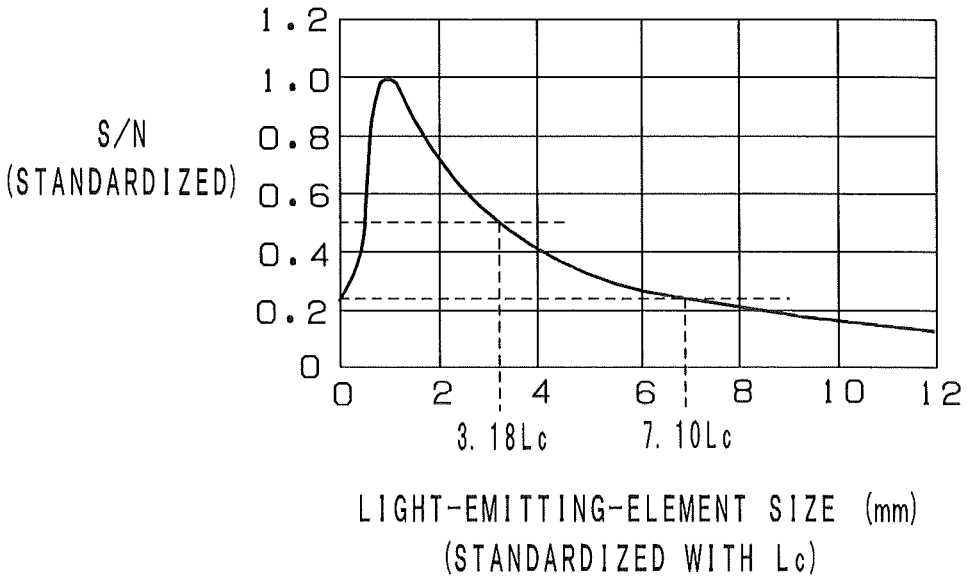
FIG. 12 is a graph showing a relation between the light-receiving element size and the S/N ratio.

FIG. 12 shows a relation between light-receiving-element size (the size of a series of light-emitting elements coupled together) and S/N ratio (the ratio of luminance output to darkness output). As is apparent from FIG. 12, there is a light-receiving-element size permitting a maximum S/N ratio. When the light-receiving-element size is equal to or greater than 7.10 Lc, the S/N ratio becomes so low as to offset the signal amplifying effect achieved by an increase in the light-receiving-element size. This is attributed to the fact that the luminous output has a certain distribution, while the darkness output changes linearly in response to the light-receiving-element size. In view of this, it is preferred that the maximum light-emitting-element and light-receiving-element distance (the distance between a light-emitting-element and a series of light-receiving-elements to receive light emitted from the light-emitting element, for example, the distance between the light-emitting element A2 and the light-receiving element B2 in FIG. 9) is equal to or less than 7.64 Lc (0.54 Lc+7.1 Lc). Further, it is more desired that the maximum light-emitting-element and light-receiving-element distance is equal to or less than 3.72 Lc (0.54 Lc+3.18 Lc).

First Example of Drive Mechanism; See FIG. 13

Figure 13:
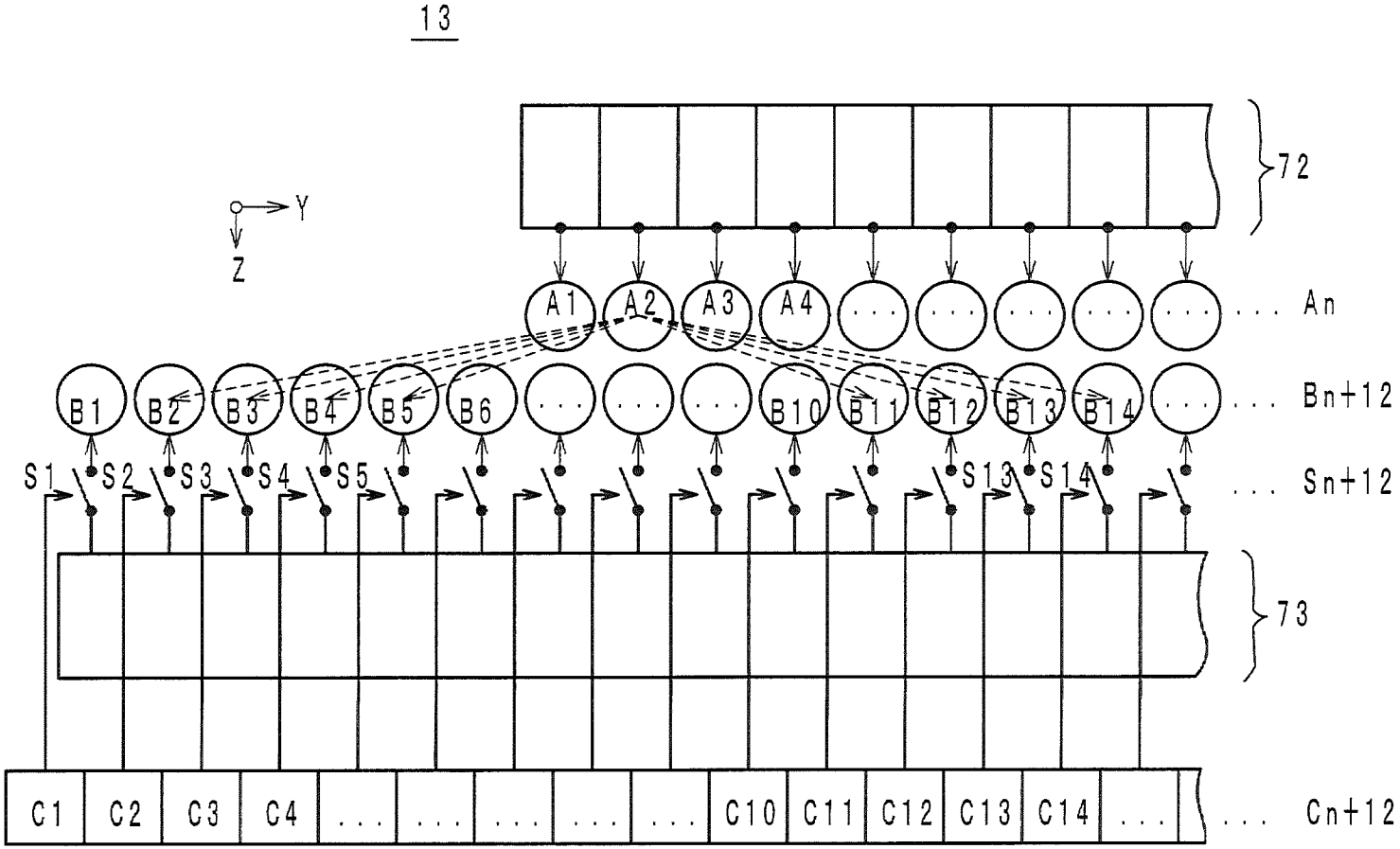
FIG. 13 is a block diagram showing a first example of a drive mechanism.

FIG. 13 shows a first exemplary drive mechanism for driving the optical writing device 13. FIG. 13 shows a case wherein the first exemplary drive mechanism is used for the optical writing device 13 according to the fourth embodiment shown by FIG. 9. In the first exemplary drive mechanism, selection switches S1 to Sn+12 are provided between the light-quantity measurement circuit section 73 and the respectively corresponding light-receiving elements B1 to Bn+12, and a shift register having internal storage elements C1 to Cn+12 is provided to control on/off actions of the switches S1 to Sn+12 sequentially.

In the drive mechanism shown by FIG. 13, while only one light-emitting element to be targeted for the light-quantity measurement is lighted, the selection switches connected to the predetermined light-receiving elements to be used for the light-quantity measurement of the target light-emitting element are turned on simultaneously by the shift register, whereby the predetermined light-receiving elements are connected to the light-quantity measurement circuit section 73. The light-quantity measurement circuit section 73 receives output signals from the switched-on light-receiving elements simultaneously and completes the light-quantity measurement of the target light-emitting element. Thereafter, data is shifted in the shift register by one step, and the light-quantity measurement of the next target light-emitting element is carried out. By repeating this process to drive the light-emitting elements and the light-receiving elements sequentially, all of the light-emitting elements are subjected to the light-quantity measurement.

Second Example of Drive Mechanism; See FIG. 14

Figure 14:
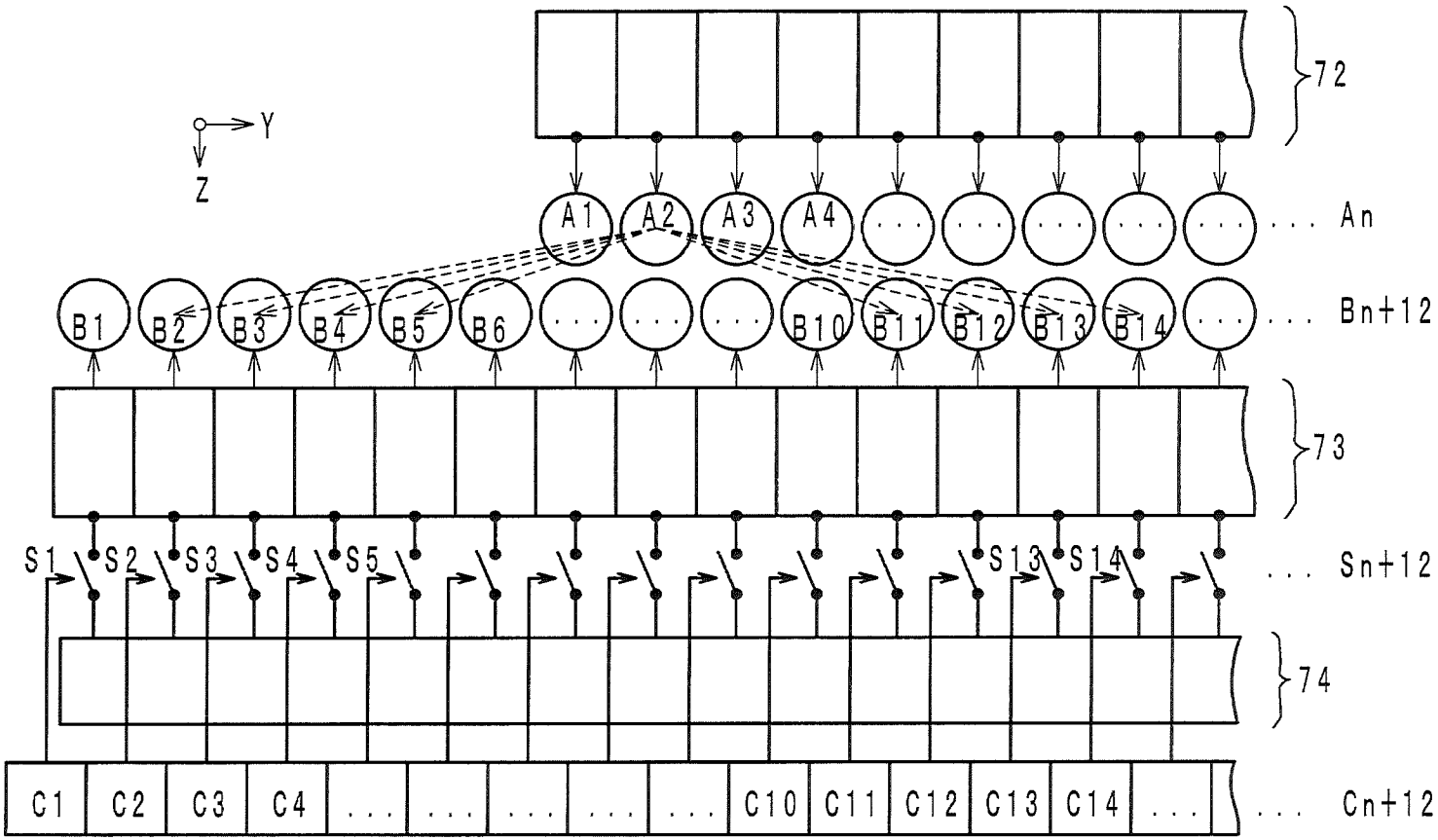
FIG. 14 is a block diagram showing a second example of a drive mechanism.

FIG. 14 shows a second exemplary drive mechanism for driving the optical writing device 13. FIG. 14 shows a case wherein the second exemplary drive mechanism is used for the optical writing device 13 according to the fourth embodiment shown by FIG. 9. In the second exemplary drive mechanism, light-quantity measurement circuit sections 73 are arranged for the respective light-emitting elements, and an output summation section 74 is located at a subsequent stage to the light-quantity measurement circuit sections 73. The output summation section 74 is connected to the light-quantity measurement circuit sections 73 via selection switches S1 to Sn+12, respectively. Further, a shift register having internal storage elements C1 to Cn+12 is provided to control on/off actions of the switches S1 to Sn+12 sequentially.

The fundamental operation of the drive mechanism shown by FIG. 14 is the same as the first exemplary drive mechanism. Only outputs from the light-receiving measurement circuit sections 73 connected to the light-receiving elements used for the light-quantity measurement of a target light-emitting element are summed up at the output summation section 74, whereby a light-quantity output signal for the target light-emitting element is obtained.

In the first exemplary drive mechanism and the second exemplary drive mechanism, only by providing switching elements to be turned on/off by a shift register, it becomes possible to measure the quantity of light emitted from a light-emitting element by use of a plurality of light-receiving elements.

OTHER EMBODIMENTS

Optical writing devices and image forming apparatuses according to the present invention are not limited to the embodiments above.

For example, it is preferred that the drive circuit section 72 and the light-quantity measurement circuit section 73 are mounted on the substrate 50 integrally. An integrated circuit having the functions as these sections may be mounted on the substrate 50. When a plurality of light-receiving elements are used to measure the quantity of light emitted from a light-emitting element, the output summation section 74 for generating a light-quantity output signal may be mounted on the substrate 50 integrally with the circuit sections 72 and 73 or may be mounted on the substrate 50 as a separate circuit structure. As the light-emitting elements, light-emitting diodes (LEDs) may be used instead of organic EL elements.

It is not necessary that the light-emitting elements are subjected to the light-quantity measurement one by one. For example, light-emitting elements located so away from each other that light emitted from the light-emitting elements causes no effects on each other may be targeted for the light-quantity measurement at the same time. Also, the light-quantity adjustment section 71 shown in FIG. 4 may be provided in the optical writing device 13.

Although each of the embodiments above shows a case where the light-emitting elements and the light-receiving elements are arranged in the main-scanning direction at the same pitch, the arrangement pitch of the light-emitting elements and the arrangement pitch of the light-receiving elements are not necessarily the same. However, it is preferred that the distance L is within a range from 0.54 Lc to 7.64 Lc. In a case where the light-emitting elements and the light-receiving elements are arranged at different pitches, according to the first embodiment as shown by FIG. 5, the number of light-emitting elements and the number of light-receiving elements are different, and usage of the light-receiving elements for the light-quantity measurements of the light-emitting elements are not on a one-to-one basis.

Figure 15:
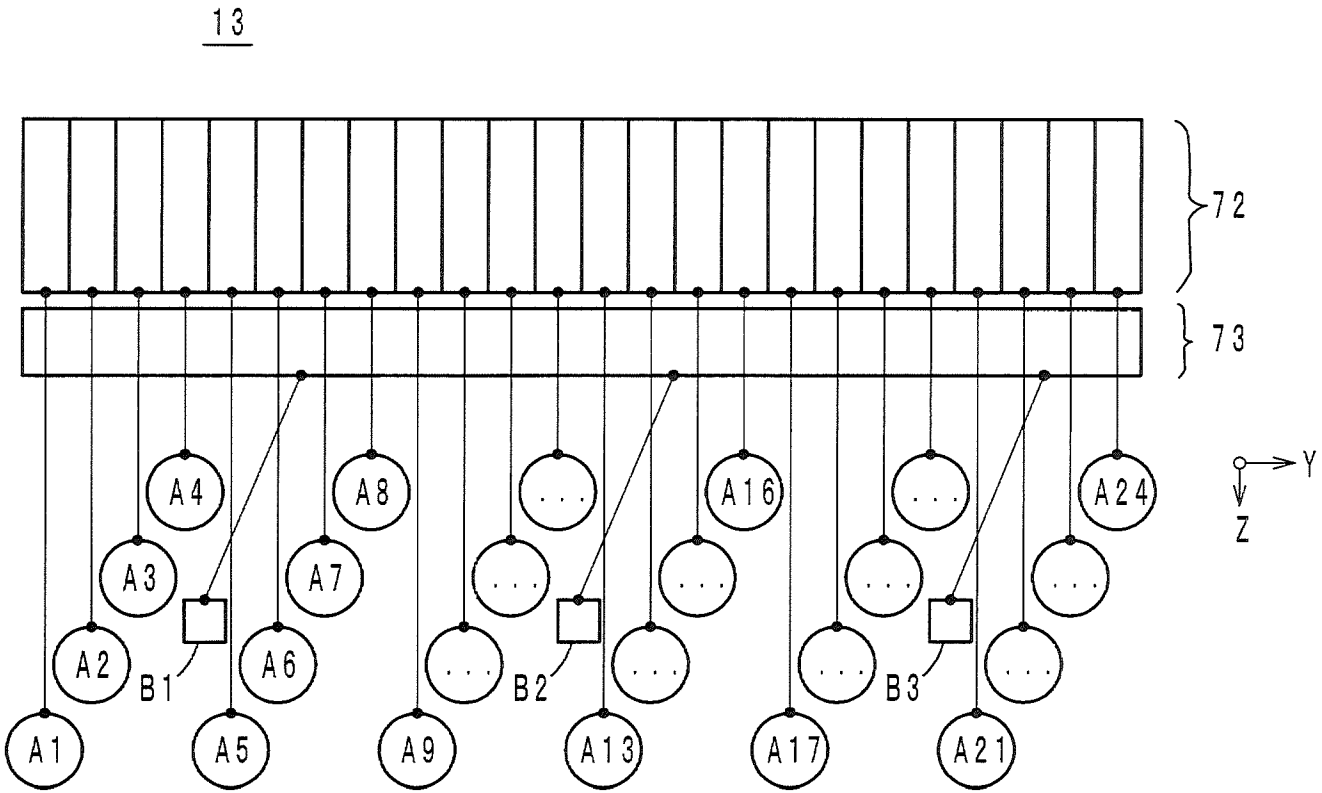
FIG. 15 is a schematic plan view of light-emitting elements and light-receiving elements according to a modification regarding the positional relation between the light-emitting elements and the light-receiving elements.

Although each of the embodiments above shows a case where the light-emitting elements are arranged in a line in the main-scanning direction, it is not always necessary that the light-emitting elements are arranged in this way. For example, as shown by FIG. 15, a plurality of light-emitting elements A1 . . . may be staggered. Also, the light-emitting elements may be arranged in a plurality of lines so as to permit multiple exposure of each pixel. As shown by FIG. 15, the light-receiving elements B1 . . . may be located among the lines of light-emitting elements. In the case shown by FIG. 5, one light-receiving element detects light emitted from its surrounding eight light-emitting elements. For example, the light-receiving element B1 detects light emitted from the light-emitting elements A1 to A8.

Figure 16:
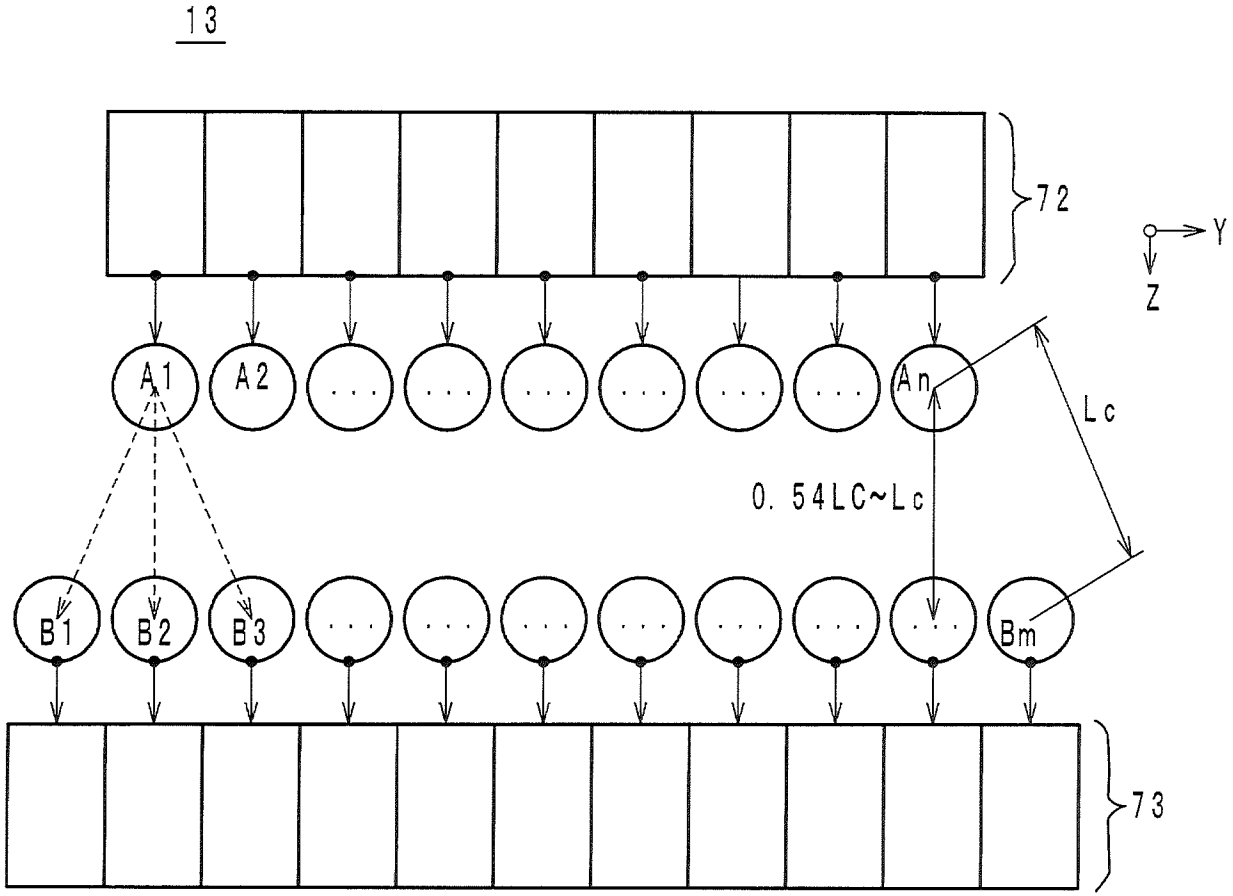
FIG. 16 is a schematic plan view of light-emitting elements and light-receiving elements according to a modification regarding the positional relation between the light-emitting elements and the light-receiving elements.

It is not always necessary that the quantity of light emitted from a light-emitting element is detected by one or more light-emitting elements located in different positions from the light-emitting element with respect to the main-scanning direction. For example, as shown by FIG. 16, when the distance between the light-emitting-element array and the light-receiving-element array is within a range from 0.54 Lc to Lc, for the light-quantity measurement of a light-emitting element (for example, the light-emitting element A1), a light-receiving element located in the same position as the light-emitting element with respect to the main-scanning direction Y (the light-receiving element B2) can be used. In this case, even the use of the light-receiving element can achieve an improvement in the light-receiving efficiency. Thus, when the distance L is close to the critical-angle-determined distance Lc, light emitted from a light-emitting element can be received with high efficiency by the light-receiving element located in the same position as the light-emitting element with respect to the main-scanning direction Y. This arrangement is more effective when the light-receiving elements are of a larger size than the light-emitting elements. In sum, it is necessary that the distance L is within a range from 0.54 Lc to 7.64 Lc.

As described above, the embodiments above inhibits enlargement of the substrate in the sub-scanning direction and improves the light-receiving efficiency of the light-receiving elements.

Although the present invention has been described in connection with the preferred embodiments above, it is to be noted that various changes and modifications may be possible to those who are skilled in the art. Such changes and modifications are to be understood as being within the scope of the present invention.

What is claimed is:

1. An optical writing device for forming an electrophotographic image on a photoreceptor by exposing the photoreceptor to light modulated in accordance with image data, the optical writing device comprising:

a substrate;

a light-emitting-element array including a plurality of light-emitting elements supported by the substrate to be arranged in a main-scanning direction; and a light-receiving-element array substantially in parallel to the light-emitting-element array, the light-receiving-element array including a plurality of light-receiving elements supported by the substrate to be arranged in the main-scanning direction;

wherein for light-quantity measurement of one of the light-emitting elements, at least an output value output from one of the light-receiving elements of which center is located in a different position, with respect to the main-scanning direction, from a center of the one of the light-emitting elements is used.

2. The optical writing device according to claim 1, wherein the substrate is light transmissive.

3. The optical writing device according to claim 1, wherein a distance between one of the light-emitting elements and one of the light-receiving elements to be used for light-quantity measurement of the one of the light-emitting elements is equal to or greater than 0.54 times a critical-angle-determined distance Lc.

4. The optical writing device according to claim 3, wherein the distance is equal to or greater than 0.9 times the critical-angle-determined distance Lc.

5. The optical writing device according to claim 3, wherein the distance is equal to or less than 7.64 times the critical-angle-determined distance Lc.

6. The optical writing device according to claim 5, wherein the distance is equal to or less than 3.72 times the critical-angle-determined distance Lc.

7. The optical writing device according to claim 1, wherein the light-emitting elements are organic EL elements.

8. The optical writing device according to claim 1, wherein the light-receiving-element array has a larger size in the main-scanning direction than the light-emitting-element array.

9. The optical writing device according to claim 8, wherein for light-quantity measurement of one of the light-emitting elements, two or more of the light-receiving elements are used.

10. The optical writing device according to claim 8, wherein for light-quantity measurement of one of the light-emitting elements, two or more of the light-receiving elements located at opposite sides of the one of the light-emitting elements in the main-scanning direction are used.

11. The optical writing device according to claim 1, wherein the light-receiving-element array has a smaller size in the main-scanning direction than the light-emitting-element array.

12. The optical writing device according to claim 1, wherein the light-receiving-element array has substantially a same size in the main-scanning direction as the light-emitting-element array and is displaced from the light-emitting-element array in the main-scanning direction.

13. The optical writing device according to claim 1, further comprising:

a light-quantity measurement circuit section configured to receive output values from the light-receiving elements; and switching elements located between the light-quantity measurement circuit section and the respective light-receiving elements.

14. The optical writing device according to claim 13, further comprising a shift register configured to control the switching elements.

15. An image forming apparatus comprising:

the optical writing device according to claim 1; and a light-emission adjustment section configured to adjust a light-emission value of one of the light-emitting elements based on at least an output value output from one of the light-receiving elements used for light-quantity measurement of the one of the light-emitting elements.

* * * * *